US011248332B2

(12) United States Patent
Kwon et al.

(10) Patent No.: US 11,248,332 B2
(45) Date of Patent: Feb. 15, 2022

(54) LAUNDRY TREATING APPARATUS

(71) Applicant: LG ELECTRONICS INC., Seoul (KR)

(72) Inventors: Yongwoo Kwon, Seoul (KR); Jungsang You, Seoul (KR); Donghyun Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 133 days.

(21) Appl. No.: 16/776,709

(22) Filed: Jan. 30, 2020

(65) Prior Publication Data

US 2020/0248392 A1 Aug. 6, 2020

(30) Foreign Application Priority Data

Feb. 1, 2019 (KR) ..... 10-2019-0014063
May 17, 2019 (KR) ..... 10-2019-0058251

(51) Int. Cl.
*D06F 39/14* (2006.01)
*D06F 58/20* (2006.01)

(52) U.S. Cl.
CPC ..... *D06F 39/14* (2013.01); *D06F 58/20* (2013.01)

(58) Field of Classification Search
CPC ..... D06F 39/14; D06F 58/20
See application file for complete search history.

(56) References Cited

U.S. PATENT DOCUMENTS 6,256,823 B1 7/2001 Kronbetter et al.
8,148,633 B2 4/2012 Hung
8,555,681 B2 10/2013 Caudevilla De Sola et al.
8,570,737 B2 10/2013 Rayner
2004/0177656 A1 9/2004 Kwon
2005/0034486 A1 2/2005 Bienick et al.
2006/0117813 A1 6/2006 Ha et al.
2006/0218975 A1 10/2006 Graute et al.
2007/0137261 A1 6/2007 Kwon
(Continued)

FOREIGN PATENT DOCUMENTS

CN 1880559 12/2006
CN 101074531 11/2007
(Continued)

OTHER PUBLICATIONS

CN104975466A—Machine translation (Year: 2015).*
(Continued)

*Primary Examiner* — Tinsae B Ayalew
(74) *Attorney, Agent, or Firm* — Ked & Associates LLP

(57) ABSTRACT

A laundry treating apparatus may include a main body having a front panel with a laundry inlet port, and a recess recessed into the front panel to surround the laundry inlet port, and a door to open and close the laundry inlet port. The door may include an outer frame provided with a front glass on a front surface thereof, and having an outer circumferential portion that surrounds an outer surface of the front glass and protrudes outward of the recess; a door window corresponding to the laundry inlet port; an inner frame disposed toward the recess; and a contact portion provided between outer side and inner side of the inner frame to contact a recessed portion of the recess when the door is closed, whereby the door may be prevented from being lifted.

23 Claims, 10 Drawing Sheets

(56) References Cited

U.S. PATENT DOCUMENTS

| | | | |
|---|---|---|---|
| 2008/0223085 | A1 | 9/2008 | Park |
| 2009/0165391 | A1 | 7/2009 | Kocak et al. |
| 2015/0003027 | A1 | 1/2015 | Han et al. |
| 2017/0121889 | A1 | 5/2017 | Kwon et al. |
| 2017/0167070 | A1 | 6/2017 | Khamprachom et al. |
| 2017/0260678 | A1 | 9/2017 | Wee et al. |
| 2018/0163333 | A1 | 6/2018 | Zhang et al. |
| 2018/0195226 | A1 | 7/2018 | Kwon et al. |
| 2018/0216282 | A1 | 8/2018 | Lee et al. |
| 2018/0274155 | A1 | 9/2018 | Anand et al. |
| 2018/0363198 | A1 | 12/2018 | Gim |

FOREIGN PATENT DOCUMENTS

| | | |
|---|---|---|
| CN | 104372569 | 2/2015 |
| CN | 104420137 | 3/2015 |
| CN | 204311247 | 5/2015 |
| CN | 104975466 | 10/2015 |
| CN | 204780322 | 11/2015 |
| CN | 105937137 | 9/2016 |
| CN | 107287850 | 10/2017 |
| CN | 107541888 | 1/2018 |
| CN | 107641942 | 1/2018 |
| CN | 108796966 | 11/2018 |
| CN | 208293271 | 12/2018 |
| CN | 109112795 | 1/2019 |
| DE | 29721320 | 2/1998 |
| DE | 20 2012 101253 | 4/2013 |
| EP | 0 870 861 | 10/1998 |
| EP | 1 262 589 | 12/2002 |
| EP | 1 522 623 | 4/2005 |
| EP | 1 309 749 | 12/2005 |
| EP | 1 860 228 | 11/2007 |
| EP | 2 147 996 | 1/2010 |
| EP | 2 161 364 | 3/2010 |
| EP | 2 677 076 | 12/2013 |
| EP | 3 112 524 | 1/2017 |
| EP | 2 740 833 | 4/2017 |
| EP | 3 162 945 | 5/2017 |
| EP | 3 181 750 | 6/2017 |
| EP | 3 332 060 | 6/2018 |
| EP | 3 363 945 | 8/2018 |
| FR | 2691298 | 11/1993 |
| FR | 2756575 | 6/1998 |
| GB | 2118580 | 11/1983 |
| GB | 2320507 | 6/1998 |
| IT | VR20120061 | 9/2017 |
| JP | H06-31766 | 4/1994 |
| JP | H10-24130 | 1/1998 |
| JP | 2000-145022 | 5/2000 |
| JP | 2005-058771 | 3/2005 |
| JP | 2005-160952 | 6/2005 |
| JP | 2008-295957 | 12/2008 |
| JP | 2012-223344 | 11/2012 |
| JP | 2014-003293 | 1/2014 |
| JP | 2014-151948 | 8/2014 |
| JP | 2016-049112 | 4/2016 |
| JP | 2017-038828 | 2/2017 |
| JP | 2017-099993 | 6/2017 |
| JP | 2018-514346 | 6/2018 |
| JP | 2018-110645 | 7/2018 |
| JP | 2018-531753 | 11/2018 |
| JP | 2018-532545 | 11/2018 |
| JP | 2018-536517 | 12/2018 |
| KR | 10-2004-0011219 | 2/2004 |
| KR | 10-0465148 | 1/2005 |
| KR | 2005-0021057 | 3/2005 |
| KR | 10-0595180 | 6/2006 |
| KR | 10-2007-0002458 | 1/2007 |
| KR | 10-2010-0019091 | 2/2010 |
| KR | 10-2010-0042984 | 4/2010 |
| KR | 10-2011-0013011 | 2/2011 |
| KR | 10-2011-0028899 | 3/2011 |
| KR | 10-1138697 | 6/2012 |
| KR | 10-1156707 | 6/2012 |
| KR | 10-2015-0003592 | 1/2015 |
| KR | 10-2015-0006264 | 1/2015 |
| KR | 10-2016-0041886 | 4/2016 |
| KR | 10-1708350 | 2/2017 |
| KR | 10-1708351 | 2/2017 |
| KR | 10-1708352 | 2/2017 |
| KR | 10-1708355 | 2/2017 |
| KR | 10-2018-0089992 | 8/2018 |
| KR | 10-2018-0136086 | 12/2018 |
| KR | 10-2018-0136094 | 12/2018 |
| KR | 10-2018-0136095 | 12/2018 |
| KR | 10-2018-0136102 | 12/2018 |
| RU | 2355836 | 5/2009 |
| WO | WO 2015/144236 | 10/2015 |
| WO | WO 2017/020959 | 2/2017 |
| WO | WO 2018/001160 | 1/2018 |
| WO | WO 2018/077130 | 5/2018 |
| WO | WO 2018/138946 | 8/2018 |

OTHER PUBLICATIONS

Japanese Office Action dated Dec. 15, 2020 issued in JP Application No. JP 2020-013134.

Japanese Office Action dated Dec. 15, 2020 issued in JP Application No. JP 2020-013137.

Japanese Office Action dated Feb. 2, 2021 issued in JP Application No. JP 2020-013079.

Russian Office Action issued in Application No. 2020200539 dated Jun. 11, 2020.

European Search Report issued in Application No. 20152173.9 dated Jul. 1, 2020.

Australian Office Action issued in Application No. 2020102680/03 dated Aug. 17, 2020.

Russian Notice of Allowance dated Apr. 21, 2020 issued in RU Application No. 2020103239.

Russian Notice of Allowance dated May 15, 2020 issued in RU Application No. 2020103240.

Russian Office Action dated Jun. 18, 2020 issued in RU Application No. 2020103247.

Russian Notice of Allowance dated May 25, 2020 issued in RU Application No. 2020102678.

European Search Report dated Jul. 1, 2020 issued in EP Application No. 20152172.1.

Australian Examination Report dated Aug. 17, 2020 issued in Application No. 2020200534.

Korean Office Action dated Jun. 15, 2021 issued in KR Application No. 10-2019-0058251.

Korean Office Action dated Jun. 15, 2021 issued in KR Application No. 10-2019-0060211.

Japanese Office Action dated Mar. 2, 2021 issued in JP Application No. 2020-013080.

Australian Office Action dated Apr. 1, 2021 issued in AU Application No. 2020200550.

Japanese Office Action dated Feb. 2, 2021 issued in JP Application No. 2020-012212.

European Search Report dated Jun. 29, 2020 issued in Application No. 20152175.4.

International Search Report dated May 18, 2020 issued in PCT Application No. PCT/KR2020/001531.

Korean Office Action dated Jun. 15, 2021 issued in KR Application No. 10-2019-0127328.

Korean Office Action dated Jun. 15, 2021 issued in KR Application No. 10-2019-0127330.

Korean Office Action dated Jun. 15, 2021 issued in KR Application No. 10-2019-0127998.

Korean Office Action dated Jun. 15, 2021 issued in KR Application No. 10-2020-0011873.

Australian Office Action dated Sep. 17, 2020 issued in AU Application No. 2020200522.

European Search Report dated Jun. 24, 2020 issued in EP Application No. 20152188.7.

European Search Report dated Jun. 24, 2020 issued in EP Application No. 20152181.2.

(56) References Cited

OTHER PUBLICATIONS

European Search Report dated Jun. 24, 2020 issued in EP Application No. 20152156.4.
European Search Report dated Jul. 1, 2020 issued in EP Application No. 20152169.7.
European Search Report dated Jul. 7, 2020 issued in EP Application No. 20152158.0.
Korean Office Action dated Jul. 23, 2020 issued in KR Application No. 10-2019-0058241.
Russian Notice of Allowance dated Aug. 25, 2020 issued in RU Application No. 2020103247.
Australian Office Action dated Sep. 2, 2020 issued in AU Application No. 2020200550.
Korean Office Action dated Jun. 15, 2021 issued in KR Application No. 10-2019-0124785.
U.S. Office Action dated Dec. 15, 2021 issued in U.S. Appl. No. 16/776,820.
U.S. Appl. No. 16/776,624, filed Jan. 30, 2020.
U.S. Appl. No. 16/776,639, filed Jan. 30, 2020.
U.S. Appl. No. 16/776,683, filed Jan. 30, 2020.
U.S. Appl. No. 16/776,695, filed Jan. 30, 2020.
U.S. Appl. No. 16/776,709, filed Jan. 30, 2020.
U.S. Appl. No. 16/776,739, filed Jan. 30, 2020.
U.S. Appl. No. 16/776,780, filed Jan. 30, 2020.
U.S. Appl. No. 16/776,779, filed Jan. 30, 2020.
U.S. Appl. No. 16/776,820, filed Jan. 30, 2020.

* cited by examiner

LAUNDRY TREATING APPARATUS

CROSS-REFERENCE TO RELATED APPLICATION(S)

Pursuant to 35 U.S.C. § 119(a), this application claims the benefit of the earlier filing date and the right of priority to Korean Patent Applications No. 10-2019-0014063, filed in Korea on Feb. 1, 2019, and No. 10-2019-0058251, filed in Korea on May 17, 2019, the contents of which are incorporated by reference herein in their entirety.

BACKGROUND

1. Field

A laundry treating apparatus capable of preventing a door from being lifted is disclosed herein.

2. Background

In general, a laundry treating apparatus may include an apparatus having a function of washing or drying laundry or other items (hereinafter, collectively "laundry"). In addition, the laundry treating apparatus may be configured to have both a washing function and a drying function of the laundry.

Laundry treating apparatuses may be classified according to a laundry loading method, into a front-load type (also called "drum-type washer") in which the laundry is loaded through a front surface of a main body, and a top-load type (also called "top-load washer") in which the laundry is loaded through a top surface of a main body.

A laundry treating apparatus may include a main body having a laundry inlet port formed through a front surface, a tub provided inside of the main body to store wash water therein, a drum rotatably provided in the tub, and a door installed on the main body to open and close the laundry inlet port. The door may be provided with a door frame, and a door window provided on the door frame to view inside of the drum. A front portion of the door frame may protrude outward from a recess, and a rear portion of the door frame may be accommodated in the recess. The door window may protrude from a rear surface of the door frame into the drum through the laundry inlet port.

However, the related art drum type laundry treating apparatus has the following problems.

When a large amount of clothes is put into the drum, the clothes soaked with water repeatedly hit a lower portion of the door window, which protrudes into the drum, as the clothes spin together with the drum. For this reason, a lower side of the door is pushed forward and an upper side of the door is in contact with the recess of the main body to periodically apply an impact to the main body, thereby causing vibration and noise in the main body.

A drum type washing machine is disclosed in Korean Laid-Open Patent Publication No. KR 10-2011-0028899A, published on Mar. 22, 2011 and hereinafter, referred to as "Patent Document 1", which is hereby incorporated by reference. In the washing machine disclosed in Patent Document 1, a support unit is installed on a rear surface of a door. When the door opens and closes a laundry inlet port, the support unit maintains a predetermined distance between the door and a main body.

More specifically, the support unit is brought into contact with a flat surface of a recess recessed into a front surface of the main body, such that the predetermined distance between the door and the main body is maintained. Accordingly, a ventilation gap is formed between the door and the main body. The support unit serves to ventilate an inner space of the main body and outside through the ventilation gap (see FIG. 4A of Patent Document 1). The support unit contacts the flat surface of the recess of the main body when the door is opened and closed, thereby alleviating an impact transferred to the main body through the door.

However, Patent Document 1 has the following problems.

First, as the support unit has a structure protruding separately from a rear surface of a door frame, an appearance of the door is spoiled. In particular, as the door frame protrudes outward from the recess of the main body and is spaced apart from the recess with the ventilation gap therebetween, the protruding structure of the door is exposed to outside through the ventilation gap even when the door is closed, thereby degrading an appearance quality of the door.

In addition, the support unit protrudes so as to contact the flat surface inside of the recess. This causes an increase in size of the support unit and adversely affects appearance quality.

Second, if a separate buffer member or elastic member for mitigating an impact is provided between the door and the main body in order to solve the problem of vibration and noise caused between the door and the main body, an installation space for the buffer member is needed between the door and the main body, which further increases a gap between the door and the main body due to a thickness of the buffer member. In addition, when wear or failure of the buffer member occurs due to friction between the buffer member and the main body, the buffer member should be replaced, causing user inconvenience.

Third, the support unit includes a support body and a magnet provided inside of the support body, so that the support body is coupled to the main body by magnetic force. As a result, the user must pull the door harder to open the door because of the attraction force of the magnet.

Korean Laid-Open Patent Publication No. 10-2010-0042984 A, published on Apr. 27, 2010 and hereafter, referred to as "Patent Document 2", discloses a drum type washing machine. According to the disclosure of Patent Document 2, an elastic member is provided on a rear surface of a door (see FIG. 3 of Patent Document 2). The elastic member may alleviate an impact by elastically compressing the door in a closing process.

However, Patent Document 2 has the following problems.

First, as the separate elastic member protrudes from a rear surface of a door frame, an appearance of the door is spoiled.

Second, when the elastic member has a protruding structure made of a rubber material, problems, such as wear, for example, are caused.

Third, when the elastic member is made of a combination of a coil spring and a cap member, its structure becomes complicated and fabricating costs increase.

BRIEF DESCRIPTION OF THE DRAWINGS

Embodiments will be described in detail with reference to the following drawings in which like reference numerals refer to like elements, and wherein.

DETAILED DESCRIPTION

Figure 1:
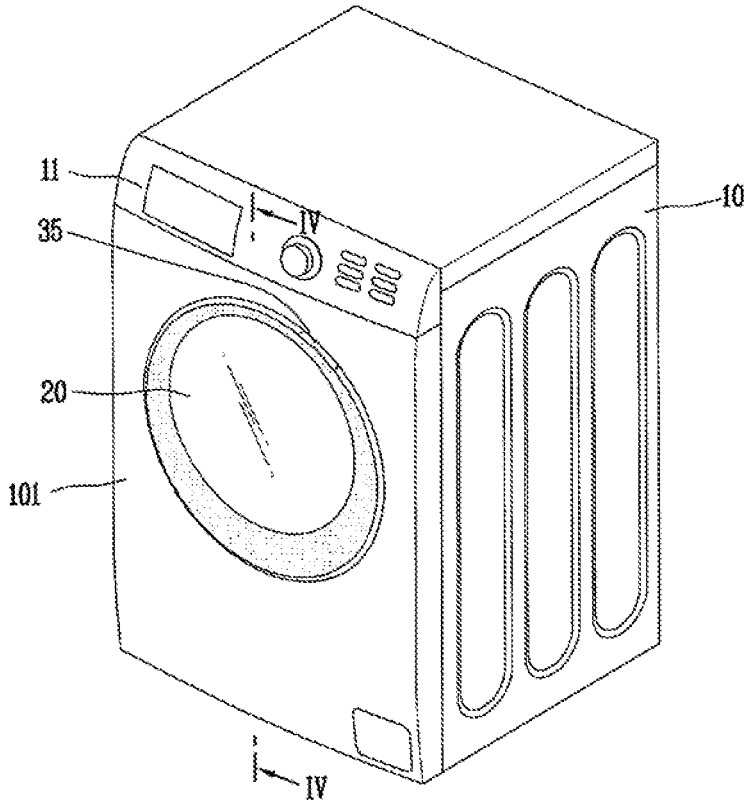
FIG. 1 is a perspective view a laundry treating apparatus according to an embodiment.

Hereinafter, embodiments will be described with reference to the accompanying drawings In the drawings, the same or similar elements are designated with the same or similar reference numeral, and redundant description has been omitted. Suffixes, such as "module" and "unit", may be used to refer to elements or components. Use of such a suffix herein is merely intended to facilitate description of the specification, and the suffix itself is not intended to give any special meaning or function. In describing embodiments, if a detailed explanation for a related known technology or construction is considered to unnecessarily divert the gist, such explanation has been omitted but would be understood by those skilled in the art. Also, it should be understood that the accompanying drawings are merely illustrated to easily explain the concept, and therefore, they should not be construed to limit the technological concept disclosed herein by the accompanying drawings, and the concept should be construed as being extended to all modifications, equivalents, and substitutes included in the concept and technological scope.

Terms including ordinal numbers such as first and second, for example, may be used herein to describe various elements, but the elements should not be limited by those terms. The terms are used merely for the purpose to distinguish an element from another element.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

A singular representation may include a plural representation as far as it represents a definitely different meaning from the context.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, constituent elements, components or combinations thereof are not excluded in advance.

FIG. 1 is a perspective view of a laundry treating apparatus according to an embodiment. The laundry treating apparatus disclosed herein may include a main body 10, a laundry accommodating portion, and a door 12. The main body 10 may define an outer shape or appearance of the laundry treating apparatus. The main body 10 may be defined in a rectangular parallelepiped shape.

The main body 10 may include a front panel 101, a rear panel, side panels, an upper panel, and a lower panel. The front panel 101 may define a front surface of the laundry treating apparatus. The rear panel may define a rear surface of the laundry treating apparatus. The side panels may define left and right or lateral surfaces of the laundry treating apparatus, respectively. The upper panel may define an upper surface of the laundry treating apparatus. The lower panel may define a lower surface of the laundry treating apparatus. A laundry inlet port 106 (see FIG. 4) may be formed in the front panel 101. The rear panel and the side panels may be defined in a "⊏" shape by bending one rectangular plate, thereby improving a structural rigidity of the main body 10.

The laundry inlet port 106 may be formed in a circular shape through the front panel 101 so as to allow laundry to be put into the laundry accommodating portion through the laundry inlet port 106. The door 12 may be rotatably coupled to the laundry inlet port 106 by a hinge unit 24 (see FIG. 3), so as to open and close the laundry inlet port 106.

The laundry accommodating portion may be provided inside of the main body 10. The laundry accommodating portion may include (accommodate) a drum to perform a drying function, or a tub and a drum to perform washing and drying functions together.

In one embodiment, in order to perform washing and drying functions together, a tub and a drum may be provided inside of the main body 10. The tub may be defined in a cylindrical shape, and disposed such that a central axis of the tub is horizontal or inclined at a predetermined angle in a lengthwise direction of the tub. Wash water may be stored inside of the tub.

A gasket may be provided at a front end portion or end of the tub to communicate with the laundry inlet port 106, thereby preventing wash water stored inside of the tub from leaking into an accommodation space of the main body 10. The drum may be provided in the tub to be rotatable with respect to the tub. A plurality of through holes may be formed through a circumferential surface of the drum to allow a fluid, such as wash water, to enter and exit the drum through the plurality of through holes.

A front portion of the drum may be open and in communication with the laundry inlet port 106. Laundry may be accommodated inside of the drum through the laundry inlet port 106.

A drive motor may be installed on a rear surface of the tub. The drive motor may be connected a rotational shaft on a rear surface of the drum. As the drive motor is driven, power of the drive motor may be transmitted to the drum through the rotational shaft, thereby rotating the drum.

The drum may be provided with a plurality of lifters therein to rotate laundry accommodated inside of the drum, thereby performing washing and drying functions. For example, when the plurality of lifters rotate along with the drum so as to spin the laundry from a bottom to a top of the drum along an inner circumferential surface of the drum, the laundry may fall to a bottom of the drum due to gravity, thereby acquiring an effect of washing dirty laundry by beating the laundry with a paddle.

A controller 11 may be configured to display information related to operations of the laundry treating apparatus to a user and to receive the user's input. The controller 11 may include a display that displays visual information. The controller 11 may also include a circular knob and a plurality of buttons for receiving the user's input.

The controller 11 may be provided on the main body 10 or provided on the door 12. In one embodiment, the controller 11 is located on an upper portion of the front panel 101 of the main body 10.

Figure 2:
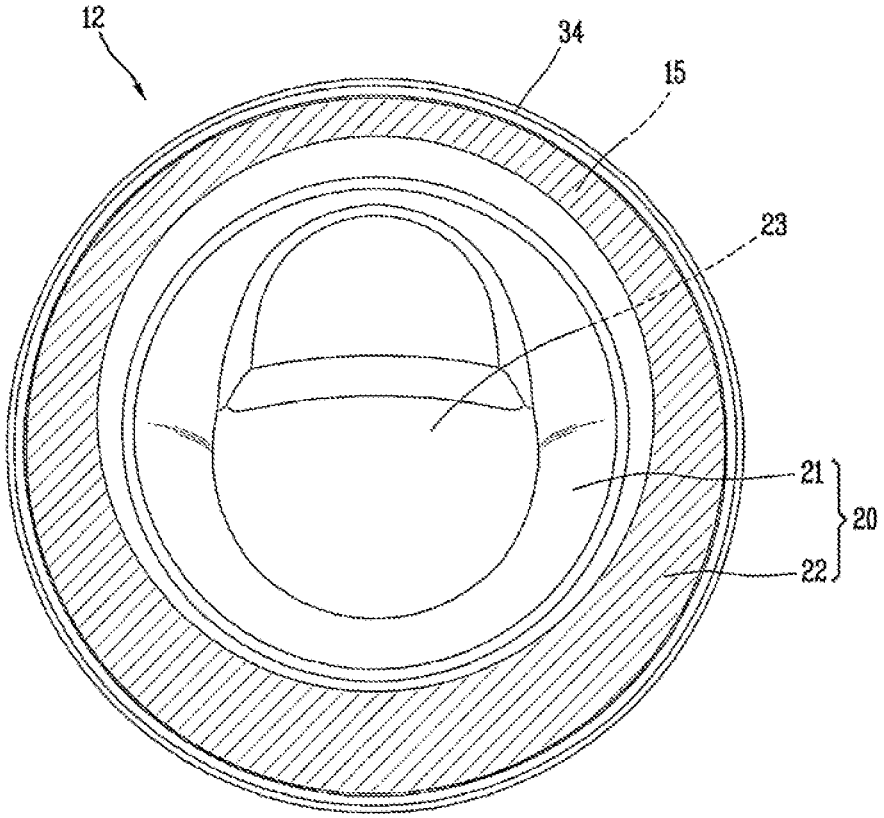
FIG. 2 is a front view of a door in FIG. 1.
Figure 3:
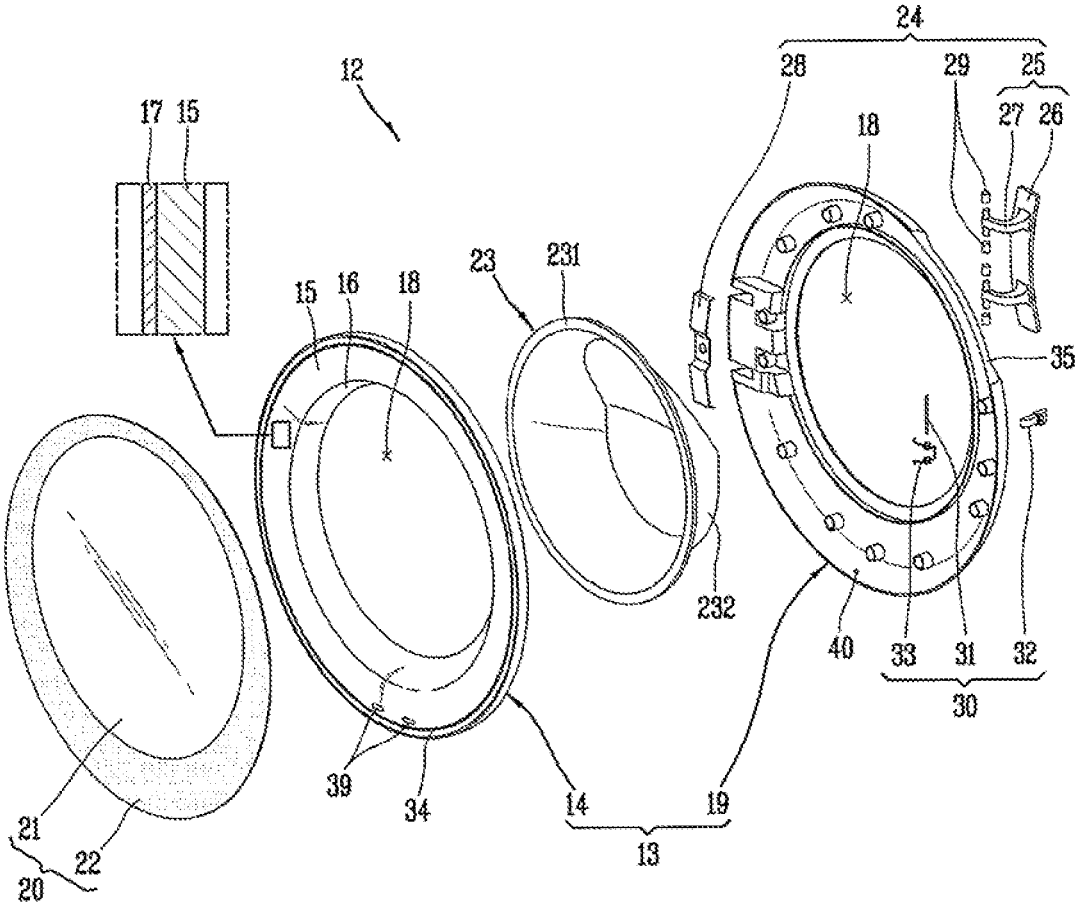
FIG. 3 is an exploded view of the door in FIG. 2.

FIG. 2 is a front view of the door 12 in FIG. 1. FIG. 3 is an exploded view of the door 12 of FIG. 2.

The door 12 may include a door frame 13, a door window 23, front glass 20, a hinge unit 24, and a locking unit 30. The door frame 13 may have a ring shape.

The door frame 13 may include an outer frame 14 and an inner frame 19. The outer frame 14 and the inner frame 19 may be formed of a synthetic resin material, for example, an acrylonitrile butadiene styrene (ABS) material, or a polycarbonate (PC) material, for example.

Each of the outer frame 14 and the inner frame 19 may be manufactured by injection molding, for example, when made of a synthetic resin material. The outer frame 14 and the inner frame 19 may each have a ring shape, and may be coupled to each other in an overlapping manner in a frontward-rearward direction. Each of the outer frame 14 and the inner frame 19 may be provided with a hook 36 (see FIG. 7) at an outer circumference thereof to be engaged with each other by for example, an interference or snap fit.

The outer frame 14 and the inner frame 19 are named as such as the outer frame 14 is disposed toward or facing an outside of the main body 10 and the inner frame 19 is disposed toward or facing an inside of the main body 10 based on a state in which the door 12 is closed. The outer frame 14 may be referred to as a "first frame", and the inner frame 19 may be referred to as a "second frame".

A circular opening 18 may be formed in each of the outer frame 14 and the inner frame 19. The openings 18 may be eccentrically positioned from centers of the outer frame 14 and the inner frame 19, respectively. For example, a center of the opening 18 may be positioned above a center of each of the outer frame 14 and the inner frame 19.

According to this embodiment, each of the outer frame 14 and the inner frame 19 may vary in width along a circumferential direction. In other words, a distance (width) between an outer diameter and an inner diameter (a diameter of the opening 18) of each of the outer frame 14 and the inner frame 19 may increase (widen) from a top end to a bottom end.

A center of the drum may be disposed higher than a center of a height (½) of the main body 10. The drum may be fixed in a heightwise direction of the main body 10 aside from minute vibration due to rotation.

Consumers tend to prefer a larger size of the door 12 with respect to a same capacity and size of washing machine when looking at the main body 10 from the front. In addition, consumers are able to look into the drum through the door 12, and if possible, prefer a wide field of view with regard to an inner space of the drum.

In order to satisfy the needs of consumers, the door 12 must be enlarged downward to increase the size of the door 12 while a position of the drum is fixed. A center of the door frame 13 must move below a center of the laundry inlet port 102 or the opening 18. Similarly, the center of the door frame 13 may move downward with respect to the door window 23 positioned to correspond to the opening 18. In addition, in order to increase the size of the door 12, a portion of the door 12 that protrudes outward from a recess 103 and the door 12 may have a larger diameter.

The front glass 20 may have in a circular shape. The front glass 20 may be made of a glass material. The front glass 20 may have flat front and rear surfaces. The front glass 20 may have in a disc shape having a constant thickness, without bending when viewed from any direction, up, down, left, or right.

As described above, the front and rear surfaces of the front glass 20 made of the glass material may be formed flat in the circular shape, thereby enhancing a quality grade of the door 12, compared to a door cover in the related art made of a synthetic resin material that has a convex front surface in an incomplete circular shape.

The front glass 20 may cover the opening 18 of the door frame 13. The front glass 20 may be bonded to a front surface of the outer frame 14 by a sealant or an adhesive.

Due to a nature of the glass material, the front glass 20 may be easily broken when a coupling hole is drilled in the front glass 20. Thus, the front glass 20 may be attached to the outer frame 14 using an adhesive, for example, to prevent the glass from being broken.

On the other hand, the front glass 20 made of the glass material occupies a relatively large load compared to a total load of the door 12. In order to support the load of the front glass 20, a mounting guide 34 to mount the front glass 20 may be provided on a front surface of the outer frame 14.

In particular, the front glass 20 may be made of tempered glass. Due to a nature of the tempered glass, the front and rear surfaces of the front glass 20 have a high strength, but a circular outer circumferential surface, which is a side surface of the front glass 20, has a low strength.

To compensate for this, the mounting guide 34 may protrude forward from a front outer circumferential end of the outer frame 14 to surround the outer circumferential surface of the front glass 20, so as to support the load of the front glass 20 as well as to protect the outer circumferential surface of the front glass 20 from external impact.

A protruding length of the mounting guide 34 may cover at least ⅔ of a thickness of the front glass 20. This is because an external impact may be applied to the outer circumferential surface of the front glass 20 and the load of the front glass 20 may not be sufficiently supported when the protruding length of the mounting guide 34 is too short.

For example, a straight portion 202 and a plurality of curved portions 201, 203 may be formed on a side surface in a radial direction at the outer circumferential surface of the front glass 20. The plurality of curved portions 201, 203 may include first curved portion 201 connected to the front surface of the front glass 20 and second curved portion 203 connected to the rear surface of the front glass 20. The straight portion 202 may extend between the first and second curved portions 201, 203 and be connected to the first and second curved portions 201, 203, respectively. Each of the first curved portion 201, the straight portion 202, and the second curved portion 203 may be ⅓ of the thickness of the front glass 20.

The mounting guide 34 may cover the second curved portion 203 and the straight portion 202 of the front glass 20. The mounting guide 34 may protrude from a front edge portion or edge of the outer frame 14. The mounting guide 34 may be formed in a ring shape to define a space in which the front glass 20 may be accommodated.

The mounting guide 34 may have a predetermined inner diameter to define a circle. The inner diameter of the mounting guide 34 may correspond to an outer diameter of the front glass 20, and thus, the mounting guide 34 may be configured to surround the outer circumferential surface of the front glass 20.

A transparent region 21 and a non-transparent region 22 may be disposed at inner and outer sides of the front glass 20, respectively. The transparent region 21 denotes a region configured to transmit at least portion of light so that an opposite side or the inside may be viewed. Therefore, the transparent region 21 may be a translucent region 21.

The transparent region 21 may correspond to the opening 18 of the outer frame 14, the opening 18 of the inner frame 19, and the door window 23. Therefore, while the door 12 is closed, the user may look into the laundry accommodating portion through the transparent region 21.

A center of the transparent region 21 may be located at a position corresponding to a center of the opening 18 of each of the outer frame 14 and the inner frame 19. The corresponding position may include not only perfect alignment of the center, but also the same in an eccentric direction of the center. In other words, the center of the transparent region 21 and the center of the opening 18 may coincide with each other, or the eccentric direction of the transparent region 21 may be the same as the eccentric direction of the opening 18.

In embodiments disclosed herein, the center of the opening 18 is eccentrically located from the center of the door frame 13 to an upper side (12 o'clock direction), and correspondingly, the center of the transparent region 21 is also eccentrically located from the center of the front glass 20 to the upper side (12 o'clock direction). The center of the transparent region 21 and the center of the opening 18 may alternatively coincide with each other.

The non-transparent region 22 may surround the transparent region 21. Also, the non-transparent region 22 does not transmit light therethrough, and thus, the glass itself may appear black in the non-transparent region 22.

The non-transparent region 22 may cover the remaining portion except for the opening 18 and a portion of the door frame 13. A boundary line between the transparent region 21 and the non-transparent region 22 surrounding the transparent region 21 may be clearly distinguished by the non-transparent region 22.

Alternatively, the boundary between the transparent region 21 and the non-transparent region 22 may be blurred through a halftone technique, thereby allowing a visual transition from the transparent region 21 to the non-transparent region 22. The non-transparent region 22 may include a plurality of shielding dots arranged around the transparent region 21, and the plurality of shielding dots may be arranged to have a lower density toward the transparent region 21.

The outer frame 14 may include a flat portion 15 and a curved portion 16. The flat portion 15 may be in contact with the rear surface of the front glass 20, and a portion of the flat portion 15 may overlap the non-transparent region 22. An adhesive may be applied to the flat portion 15 so that the front glass 20 may be adhered to the flat portion 15.

An adhesive groove 37 may be formed concave in a ring shape in a front surface of the flat portion 15 facing the front glass 20, so that adhesive may be filled therein. The rear surface of the front glass 20 may be adhered to the flat portion 15 by the adhesive.

The adhesive may overflow to an outside or an inside of the adhesive groove 37 when the adhesive is filled in the adhesive groove 37. In order to accommodate adhesive overflowing from the adhesive groove 37, adhesive overflow grooves 38 may be formed in a ring shape at an inside and an outside of the adhesive groove 37, respectively.

The adhesive groove 37 and the adhesive overflow grooves 38 may be formed at an outer side of the flat portion 15. The non-transparent region 22 of the front glass 20 may cover the adhesive groove 37 and the adhesive overflow grooves 38.

A plurality of drain holes 39 may be formed through a lower side of the flat portion 15 in a thickness direction of the flat portion 15. Accordingly, water or moisture (liquid) generated between the rear surface of the front glass 20 and a front surface of the outer frame 14 may be discharged outside through the plurality of drain holes 39.

The curved portion 16 may be curved in an arc shape having a predetermined curvature toward an outer circumference of the opening 18 formed in the inner frame 19 from an inner end of the flat portion 15. An inner portion of the flat portion 15 and the curved portion 16 may overlap an outer edge portion or edge of the transparent region 21. The opening 18 may be located at an inner side of the curved portion 16 in a radial direction.

The mounting guide 34 may be formed on an outermost portion of the flat portion 15 in the circumferential direction to protrude more than the flat portion 15. The mounting guide 34 of the outer frame 14 may surround an outer edge of the front glass 20, thereby preventing the outer edge of the front glass 20 from be released radially outward from the flat portion 15 of the outer frame 14.

A protection layer 17 may be disposed on front and outer circumferential surfaces of the outer frame 14 by chromium plating, for example. The outer frame 14 may be completely immersed in a chromium plating solution, followed by the chromium plating, so that the protection layer 17 may be formed on an entire surface of the outer frame 14. Also, the outer frame 19 may be completely immersed in a chromium plating solution, followed by the chromium plating, so that the protection layer 17 may be formed on an entire surface of the inner frame 19.

The protection layer 17 may coat the outer frame 14 with a silver polished metal color. Accordingly, the protection layer 17 may obtain an effect that it looks like bright silver circular droplets. In addition, the protection layer 17 may cause a sense of a high quality when viewed with the naked eye.

The door window 23 may be disposed to correspond to the laundry inlet port 106 while the door 12 is closed. The door window 23 may be mounted to the door frame 13 to correspond to the opening 18 of the inner frame 19.

The door window 23 may be made of a transparent material, for example, a synthetic resin material having a light transmitting property, so that an inner space of the laundry accommodating portion, such as the drum, may be viewed through the door window 23. The door window 23 may not be necessarily limited to such synthetic material but may alternatively be made of a glass material. An outer edge portion or edge 231 of the door window 23 may be inserted and coupled between the outer frame 14 and the inner frame 19.

The outer edge portion 231 of the door window 23 may have a flat shape, and may be fixedly disposed between a rear end of the curved portion 16 of the outer frame 14 and an inner end of the inner frame 19. The door 12 may be rotatably provided in a frontward-rearward direction with respect to the main body 10 by the hinge unit 24.

The hinge unit 24 may include a hinge 25, a hinge holder 28, and a bush 29. The hinge 25 may be fixed to the main body 10, and rotatably coupled to the door frame 13. The hinge 25 may include a plate-shaped base 26 coupled to the main body 10, and a rotation coupling portion 27 that protrudes from the base 26 and is rotatably coupled to the door frame 13. A plurality of rotation coupling portions 27 may be provided and spaced apart in a vertical direction.

The hinge holder 28 may be coupled to the door frame 13 to support the plurality of rotation coupling portions 27 to prevent the plurality of rotation coupling portions 27 from being released from the door frame 13. The bush 29 may be inserted onto a rotational shaft of the rotary coupling portion 27 to efficiently rotate the rotational shaft.

The hinge unit 24 may be mounted at one or a first side of the door 12, and the locking unit 30 may be provided at the other or a second side of the door 12. The locking unit 30 is configured to lock or unlock the door 12 to the body 10.

The locking unit 30 may include a shaft 31, a door latch 32, and a spring 33. The shaft 31 may pass through the door latch 32, and be mounted on the door frame 13. The spring 33 has an elastic force to be retractable during rotation of the door latch 32. According to this embodiment, the door latch 32 may be configured to be rotatable and restorable to the door frame 13 so as to lock or unlock the door 12 to the main body 10.

Figure 4:
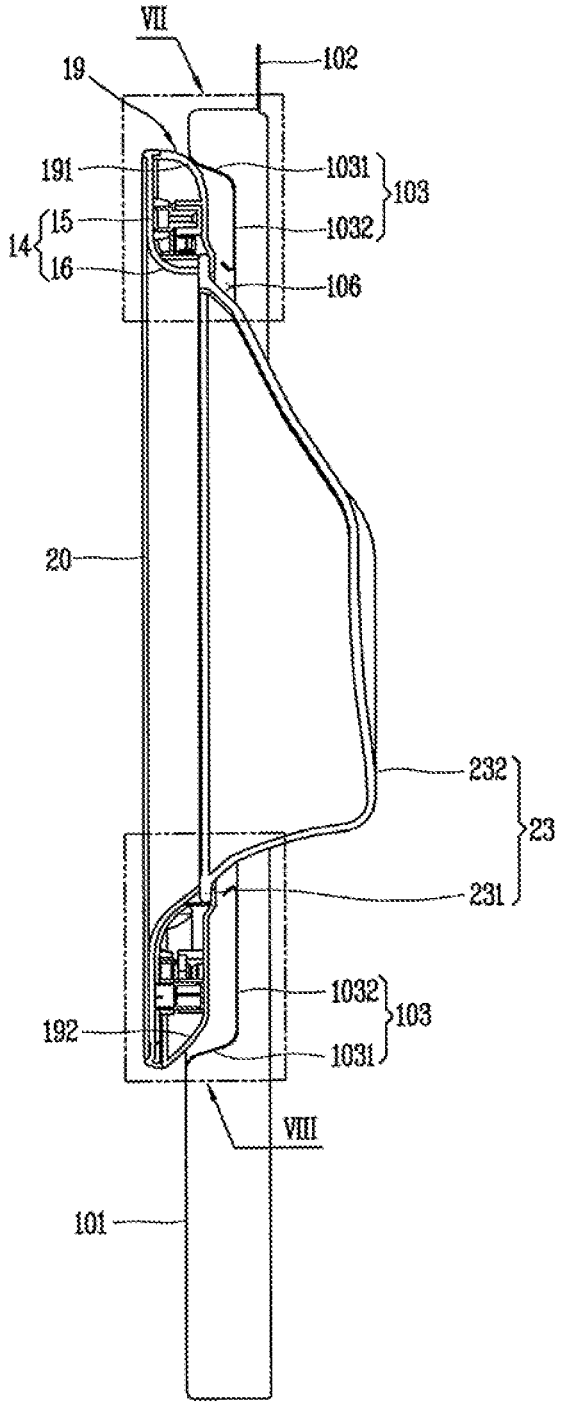
FIG. 4 is a cross-sectional view illustrating a state in which a door is mounted to a front panel of a main body to close a laundry inlet port, taken along line IV-IV in FIG. 1.
Figure 5:
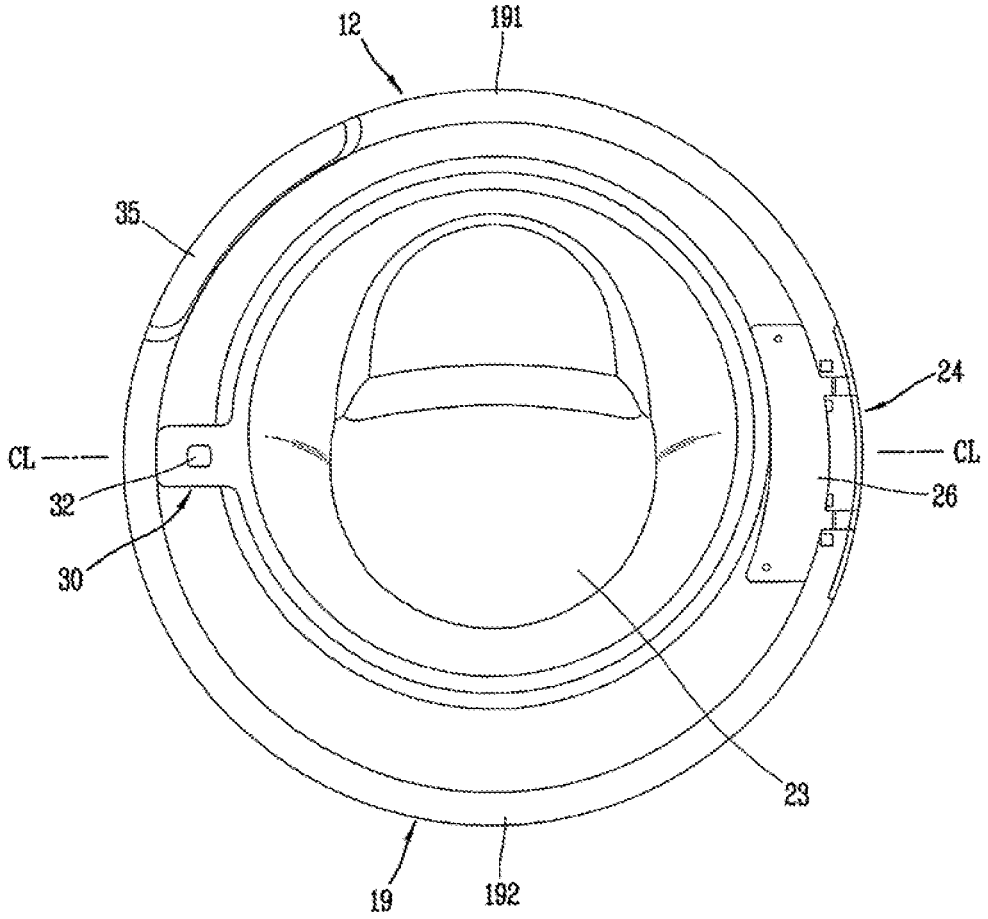
FIG. 5 is a rear view of the door in FIG. 2.
Figure 6:
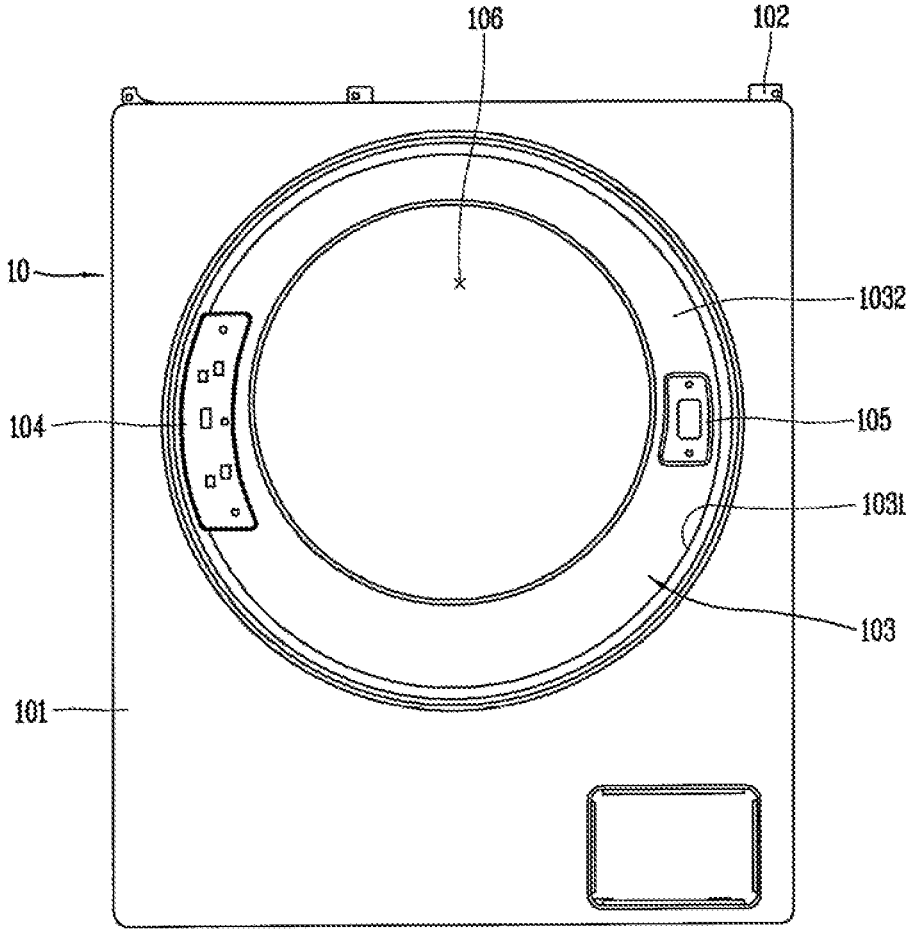
FIG. 6 is a front view illustrating a state in which a recess is recessed in a front panel to surround a laundry inlet port in FIG. 4.
Figure 7:
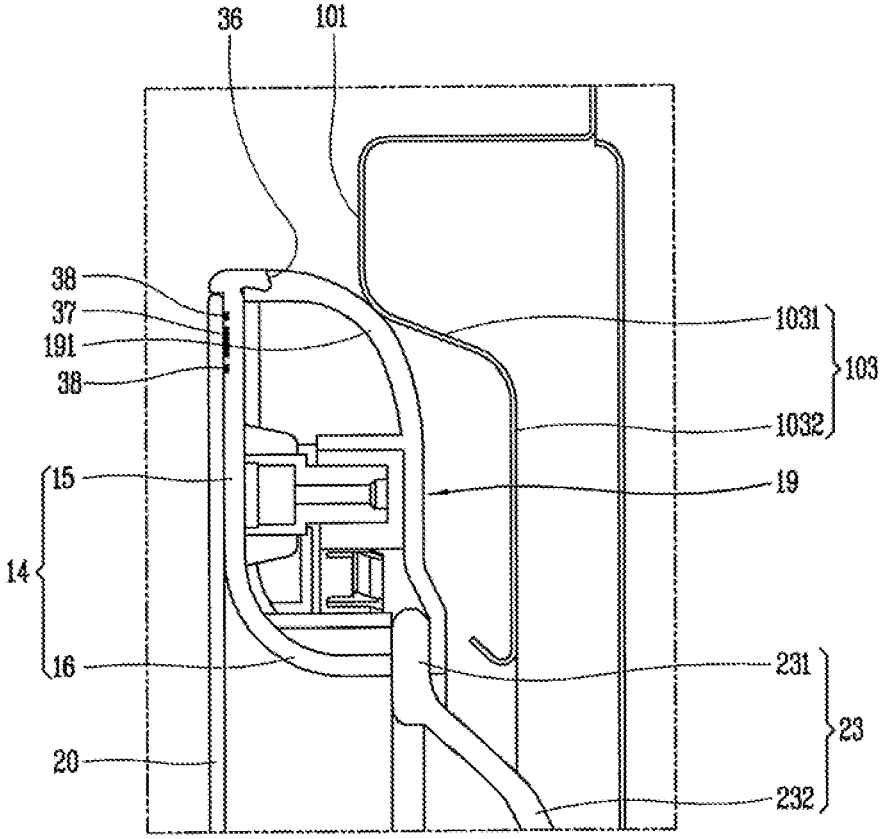
FIG. 7 is an enlarged cross-sectional view of portion "VII" in FIG. 4, in which a contact portion is in contact with a recess of a main body.
Figure 8:
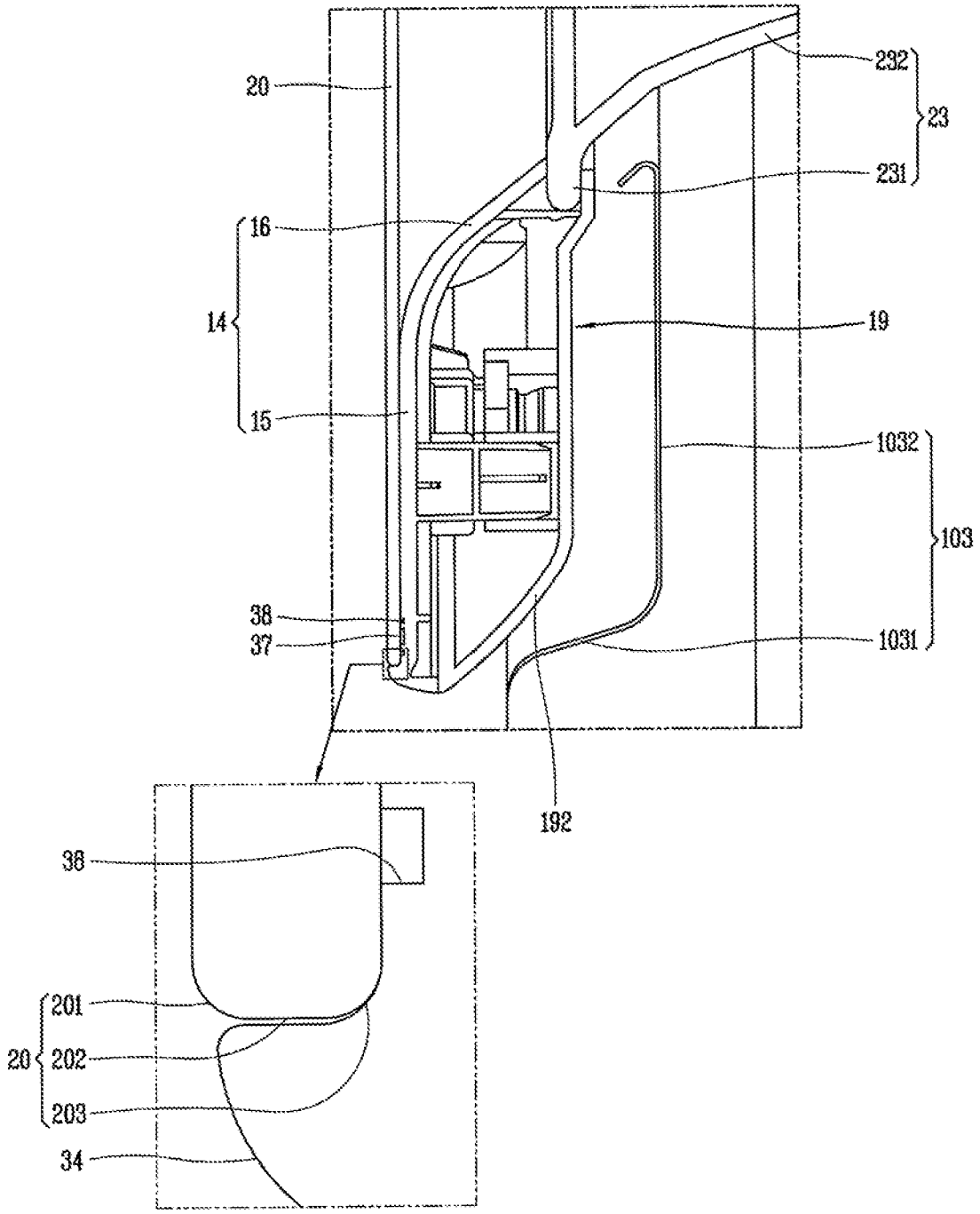
FIG. 8 is an enlarged cross-sectional view of portion "VIII" in FIG. 4, in which a non-contact portion is spaced apart from the recess of the main body.

FIG. 4 is a cross-sectional view, taken along the IV-IV in FIG. 1, illustrating a state in which the door 12 is mounted on the front panel 101 of the main body 10 to close the laundry inlet port 106. FIG. 5 is a rear view of the door in FIG. 2. FIG. 6 is a front view illustrating a state in which the recess 103 is recessed in the front panel 101 to surround the laundry inlet port 106 in FIG. 4. FIG. 7 is an enlarged cross-sectional view of portion "VII" in FIG. 4, illustrating that a contact portion 191 is in contact with the recess 103 of the main body. FIG. 8 is an enlarged cross-sectional view of portion "VIII" in FIG. 4, illustrating a state in which a non-contact portion 192 is spaced apart from the recess 103 of the main body 10.

FIG. 4 illustrates a state in which the controller 11 of FIG. 1 is removed from the upper side of the front panel 101. A plurality of ribs 102 may protrude upward from an upper end portion or end of the front panel 101. The controller 11 may be mounted on the upper end portion or end of the front panel 101. A rear surface of the controller 11 and the plurality of ribs 102 may be coupled by coupling elements, such as screws, for example.

Referring to FIGS. 4 and 5, a handle 35 may be formed by recessing a rear upper side of the inner frame 19, so that the user may open the door 12 by pulling the handle 35. The rear surface of the inner frame 19 may be convex rearward in an arcuate shape.

The handle 35 may be provided on the door 12 for the user to open and close the door 12. In the related art, the handle is generally provided at a front side of the door. However, in embodiments disclosed herein, as the front glass 20 is provided to cover a front surface of the door 12, it is difficult to provide the handle 35 on the front glass 20. Thus, the handle 35 is not provided on the front surface of the door 12 due to the front glass 20, but rather, may be provided on a rear surface of the door 12. The handle 35 may be provided on the inner frame 19.

In addition, the handle 35 may be provided at an upper portion of the door 12 for the user to easily pull the door 12. When the handle 35 is provided at a lower portion of the door 12, the user has to bend his or her waist and knees more to pull the handle 35.

Moreover, as the hinge unit 24 and the locking unit 30 are respectively provided at lateral sides of the door frame 13, respectively, along a horizontal center line CL-CL that horizontally passes through the center of the door frame 13 in the radial direction, they may be positioned higher than the horizontal center line. In addition, the handle 35 may be disposed on the upper side of the door frame 13 to be higher than the locking unit 30 in order to open and close the door 12 with less force.

The handle 35 may be disposed on the upper side of the rear surface of the inner frame 19. More specifically, when the door 12 is closed, the handle 35 may be located at a right upper portion, namely, between one o'clock and three o'clock, when viewed from the front of the main body 10.

The handle 35 may be recessed into the convex rear surface of the inner frame 19 toward the outer frame 14. The handle 35 may have an arcuate shape on the rear surface of the inner frame 19 along a partial section of the rear surface in the circumferential direction.

The handle 35 may be formed thin and flat compared to an outer circumference of the inner frame 19 (a portion of the inner frame 19 except for the handle 35). Accordingly, when the door 12 is closed by the user, the handle 35 is recessed forward in the flat shape, compared with the outer circumference on the rear surface of the inner frame 19, when viewed from the front of the main body 10, thereby facilitating insertion of the user's hand into the handle 35 as well as facilitating identification of a position of the handle 35 in the closed state of the door 12.

Referring to FIGS. 4 and 6, the recess 103 may be provided on the front panel 101 of the main body 10. The recess 103 may accommodate a portion of the door 12, particularly, a portion of the door frame 13, more particularly, a portion of the inner frame 19.

The recess 103 may include a recessed portion 1031, and a flat portion 1032. The recessed portion 1031 may be recessed rearward into the front surface of the front panel 101 toward the inside of the main body 10. The recessed portion 1031 may have a larger diameter than the laundry inlet port 106 and may be formed in a curved shape along the circumferential direction.

The recessed portion 1031 may be formed in a circular shape to surround an outer circumference of the flat portion 1032. Both sides of the recessed portion 1031 may be connected to the front surface of the front panel 101 and the flat portion 1032, so that the flat portion 1032 is stepped toward the inside of the main body 10 with respect to the front surface of the front panel 101. The recessed portion 1031 may be bent backward from the front surface of the front panel 101.

The recessed portion 1031 may be inclined while its diameter gradually decreases from a front end to a rear end thereof. The flat portion 1032 may be disposed toward the inside of the main body more rearward than the front surface of the front panel 101.

The flat portion 1032 may extend perpendicularly in the form of a flat plate, and the laundry inlet port 106 may penetrate through the inside of the flat portion 1032 in a thickness direction. The flat portion 1032 may have a ring shape.

The laundry inlet port 106 may be formed eccentrically from the center of the recess 103. For example, a center of the laundry inlet port 106 may be located higher than a center of the recess 103. As a result, a width (a radial distance) of the flat portion 1032 becomes wider (longer) from an upper portion to a lower portion of the flat portion 1032.

A hinge portion 104 to couple with the hinge unit 24 may be provided at a left or first side of the flat portion 1032, so that the hinge unit 24 may be hinged to the hinge portion 104. A locking portion 105 to couple with the locking unit 30 may be provided at a right or second side of the flat portion 1032, so that the locking unit 30 may be coupled to the locking portion 105.

The door 12 may be fixed to the left and right or lateral sides of the flat portion 1032 by the hinge unit 24 and the locking unit 30 when the laundry inlet port 106 is closed. The hinge portion 104 and the locking portion 105 may be disposed on the horizontal center line CL-CL horizontally passing through the center of the flat portion 1032 in the radial direction, when looking at the circular flat portion 1032 from the front of the main body 10.

A curling portion may be formed on an inner end of the flat portion 1032. The curling portion may have a form in which an end of the flat portion 1032 is curled into a rounded shape, thereby removing a sharp portion of the inner end of the flat portion 1032. Accordingly, damage to laundry due to friction with the inner end of the flat portion 1032 may be prevented when the laundry is loaded or unloaded through the laundry inlet port 106 located at the inner end of the flat portion 1032, and injury to a hand, for example, which may be caused due to a contact with the inner end of the flat portion 1032 may be avoided.

Referring to FIGS. 4 and 5, the door window 23 may include an outer edge portion or edge 231 formed in a circular shape on a front end thereof, and a protruding portion 232 that protrudes toward the inside of the drum from the outer edge portion 231. The protruding portion 232 may be in a curved shape. The protruding portion 232 may have an upper surface, side surfaces, a lower surface, and a rear surface. Both the side surfaces and the rear surface of the protruding portion 232 may connect the upper and lower surfaces of the protruding portion 232.

The upper and lower surfaces of the protruding portion 232 may be formed asymmetrically. For example, the upper surface of the protruding portion 232 may be inclined smoothly relative to the lower surface of the protruding portion 232, and the lower surface of the protruding portion 232 may be inclined sharply relative to the upper surface of the protruding portion 232.

The rear surface of the protruding portion 232 may be formed almost in a perpendicularly flat surface. With this configuration, the door window 23 may be disposed to cover the opening of the inner frame 19, and the protruding portion 232 may protrude into the drum through the laundry inlet port 106 when the door 12 is closed.

When a large quantity of laundry is loaded into the drum, the laundry may collide with the door window 23 protruding into the drum while rotating along an inner circumferential surface of the drum. Embodiments disclosed herein are configured to prevent the door 12 from being lifted towards the outside of the main body 10 due to the collision between the laundry and the door window 23.

That is, contact portion (pivot portion) 191 may be provided on the rear surface of the door frame 13. The contact portion 191 may be brought into contact with the main body 10 when the door 12 is closed. The contact portion 191 may be formed integrally with the rear surface of the inner frame 19. The contact portion (pivot portion) 191 may function as a pivot about which the door may pivot upon application of an internal force to the door.

The contact portion 191 may be in contact with a front end of a front panel 101, a front end of the recess 103, or a boundary portion between the front panel 101 and the recess 103. The boundary portion between the front panel 101 and the recess 103 may be a portion where the recess 103 starts to be recessed.

The recessed portion 1031 may be understood as a portion where the recess 103 starts to be recessed. The contact portion 191 may be brought into contact with the recessed portion 1031 of the recess 103. When the contact portion 191 is in contact with the recessed portion 1031 of the recess 103, a contact area between the contact portion 191 and the main body 10 may be minimized.

When the contact portion 191 is in contact with the recessed portion 1031 of the recess 103, the contact portion 191 may be smoothly connected in a curved shape to the rear surface of the inner frame 19 without protruding.

The rear surface of the inner frame 19 may have an arcuate cross section and may be convex toward the front surface of the front panel 101 and the flat portion 1032. The rear surface of the inner frame 19 may have an arcuate cross section.

The rear surface of the inner frame 19 may be asymmetric at upper and lower portions. The inner frame 19 may be formed such that an upper portion of the rear surface has a greater curvature than the lower portion of the rear surface. The rear surface of the inner frame 19 may be disposed to face the front panel 101 or the flat portion 1032. The upper portion of the rear surface of the inner frame 19 denotes a portion of the rear surface located above the horizontal center line CL-CL horizontally passing through the center of the inner frame 19 in the radial direction, when looking at the rear surface of the inner frame 19 from the rear side. The lower portion of the rear surface of the inner frame 19 denotes a portion of the rear surface located below the horizontal center line CL-CL.

The contact portion 191 may be located on the upper portion of the rear surface of the inner frame 19, so as to allow the upper portion of the rear surface of the inner frame 19 to be in contact with the recessed portion 1031 of the main body 10. The contact portion 191 may be curved on the upper portion of the rear surface of the inner frame 19. The contact portion 191 may have a curved shape having a greater curvature than that of the lower portion of the rear surface of the inner frame 19.

The contact portion 191 may have an arcuate shape from the rear surface of the inner frame 19 toward the recessed portion 1031. The contact portion 191 may circumferentially extend from the upper portion of the rear surface of the inner frame 19 so as to have an arcuate cross section. In this case, the contact portion 191 may have a circumferential length which is ½ of or shorter than an entire circumference of the inner frame along the circumferential direction of the inner frame 19. For example, when an outer diameter of the inner frame 19 is D (mm), the contact portion 191 may be $\pi D/2$ or shorter.

The contact portion 191 may be formed on one or a first side of the rear surface of the inner frame 19 or a plurality of the contact portion 191 may be formed to be spaced apart from the upper portion of the rear surface of the inner frame 19 in the circumferential direction. In this embodiment, the single contact portion 191 having the arcuate cross section extends from the upper portion of the rear surface of the inner frame 19 along the circumferential direction is shown.

Referring to FIG. 7, the recessed portion 1031 may be inclined downward toward the flat portion 1032 with respect to the perpendicularly-formed front surface of the front panel 101. An outer side of a front end of the recessed portion 1031 connected to the front surface of the front panel 101 may be rounded. The outer side of the front end of the recessed portion 1031 may be formed to have a radius of curvature which is significantly smaller than a radius of curvature of the contact portion 191.

A radius of an arc formed by the contact portion 191 may be much larger than a radius of an arc formed by the outer side of the front end of the recessed portion 1031. The arc of the contact portion 191 and the arc formed by the outer side of the front end of the recessed portion 1031 may be disposed to be adjacent to each other.

The contact portion 191 may be in contact with the outer side of the front end of the recessed portion 1031 when the door 12 is closed, and contact between the contact portion 191 and the outer side of the front end of the recessed portion 1031 may be made on curved surfaces of the arcs externally brought into contact with each other. The contact portion 191 formed on the rear surface of the door frame 13 may be in contact with one or a first side of the main body 10, namely, the outer side (rounded portion) of the front end of the recessed portion 1031 formed at the front panel 101, when the door 12 is closed. The contact portion 191 may be in point contact or line contact with the one side of the main body 10.

A first portion of the door frame 13 may protrude forward from the outer side of the recess 103 based on the contact portion 191, and a second portion of the door frame 13 may be accommodated in the recess 103.

Non-contact portion 192 may be provided on the lower portion of the rear surface of the inner frame 19. The non-contact portion 192 may be formed with a curvature smaller than that of the contact portion 191. The non-contact portion 192 may be inclined smoothly relative to the contact portion 191. The non-contact portion 192 may be spaced forward apart from the lower side of the recessed portion 1031 of the recess 103.

Therefore, according to embodiments disclosed herein, the contact portion 191 may be provided at the upper portion on the rear surface of the door frame 13, and may be brought into contact with the recessed portion 1031 of the recess 103 of the main body 10 when the door 12 is closed, so that lifting of the door 12 may be prevented even if laundry spinning along the inner circumferential surface of the drum collides with the door window 23 when the laundry is loaded in a large quantity.

More specifically, when a large quantity of laundry is accommodated in the drum, the laundry may be moved down to the bottom of the drum by gravity and centrifugal force in a state of being wet with water, and hit the lower portion of the door window 23 during spinning. When an impact is applied to the door window 23 due to the spinning of the laundry, the lower portion of the rear surface of the door frame 13 may be pressed from the inside to outside of the drum.

In the state in which the hinge unit 24 and the locking unit 30 respectively disposed at the lateral sides on the rear surface of the door frame 13 are fixed to the flat portion 1032, the contact portion 191 provided at the upper portion on the rear surface of the door frame 13 may be brought into contact with the recessed portion 1031 formed in the front panel 101 of the main body 10, so as to resist lifting of the door 12, thereby preventing vibration or shaking of the door 12 even if an impact is applied to the lower portion of the door frame 13. In addition, the contact portion 191 extends in an arcuate curved shape along the circumferential direction of the door frame 13. The contact portion 191 may not protrude from one side of the rear surface of the door frame 13, but rather, may form a curved surface smoothly connected to its adjacent portions without a bent portion, thereby allowing the door to have a beautiful appearance.

In particular, the rear surface of the door 12 may be brought into contact with the recessed portion 1031 where the recess 103 starts to be recessed, by the contact portion 191. The contact portion 191 may cover the inside of the recess 103. Therefore, the door window 23 protruding from the rear surface of the door to the inner space of the main body 10 may be covered, thereby improving an appearance of the door 12. In addition, the contact portion 191 of the door 12 may not protrude from the rear surface of the door 12, but rather, may be brought into contact with the recessed portion 1031 where the recess 103 starts to be recessed, without being in contact with the flat portion 1032 of the recess 103, thereby preventing an increase in unnecessary material cost due to an increase in size of the contact portion 191.

Also, the contact portion 191 may be curved toward the front panel 101 or the recess 103 to have a cross section in an arcuate shape, so as to be in point contact or line contact with the recessed portion 1031, thereby minimizing a contact area of the contact portion 191 when the door 12 is closed. Accordingly, an impact applied to the main body 10 may be dispersed along the circumferential direction of the recess 103 when the main body 10 is brought into contact with the contact portion 191 due to rotation of the door 123, resulting in minimizing the impact applied to the main body 10.

A contact state between the contact portion 191 and the main body 10 may be maintained after the door 12 is closed, and thus, vibration and noise occurring between the door 12 and the main body 10 may be minimized even though an impact is repetitively applied from the laundry accommodated in the drum through the door window 23. In addition, even if the lower portion of the door frame 13 is lifted inside of the drum due to the impact applied to the door window 23, lateral sides of the door 12 and the upper end of the door 12 may be supported at a plurality of points on the front panel 101. For example, the plurality of points may include at least three support points, such as each vertex of a triangle. Both left and right or lateral support points of the three support points may be formed as the hinge unit 24 and the locking unit 30 of the door 12 are coupled to the main body 10. The upper support point of the three support points may be formed by the contact between the contact portion 191 and the main body 10. According to this, a suppression force against vibration or shaking of the door 12 may be improved significantly.

In addition, as the arcuate curved surface of the contact portion 191 and the arcuate curved surface of the recessed portion 1031 where the door 12 and the main body 10 are in contact with each other may realize a point contact or a line contact with each other, thereby minimizing friction between mutual contact surfaces. Moreover, even if lifting of the door 12 occurs, the contact point between the door frame 13 and the recess 103 moves on the arcuate curved surface, so as to prevent the contact portion 191 of the door frame 13 from being spaced apart from the main body 10, thereby achieving stable contact.

In addition, an impact transferred from the inside of the drum through the door window 23 may be alleviated by virtue of stable contact between the contact portion 191 of the door frame 13 and the recess 103 of the main body 10. Accordingly, neither a separate buffer member between the door 12 and the main body 10 nor an installation space of the buffer member are needed, thereby accommodating more of the door 12 in the recess 103, resulting in implementing a compact arrangement of the door 12.

Figure 9:
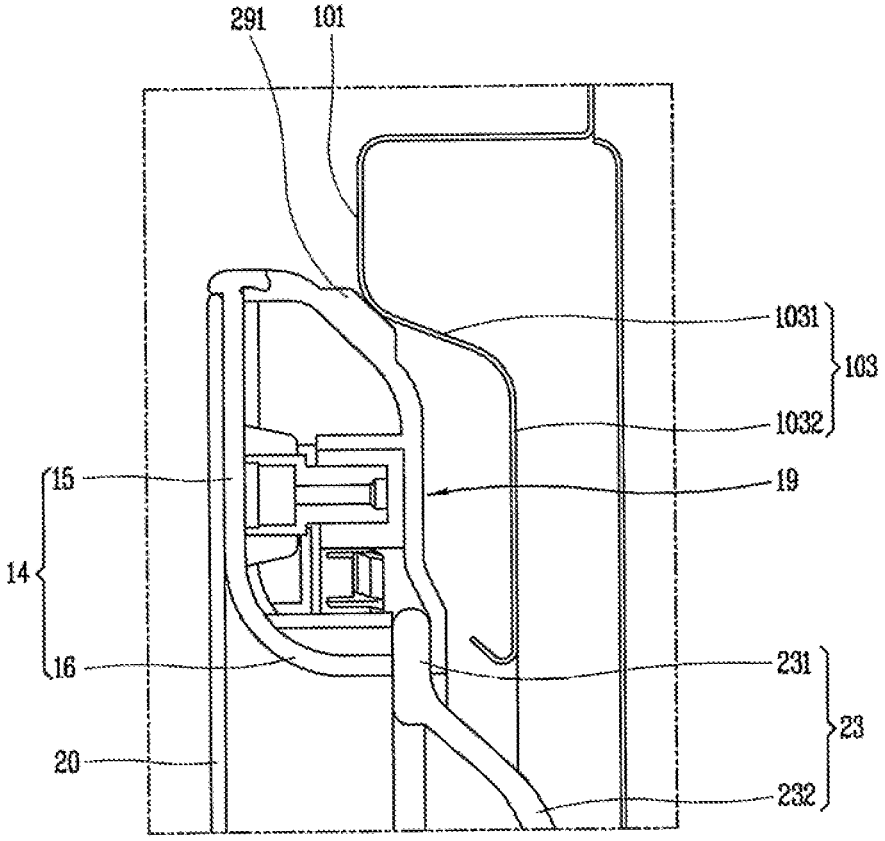
FIG. 9 is a schematic view illustrating a state in which a contact portion protrudes from one side of a rear surface of a door frame in accordance with another embodiment.
Figure 10:
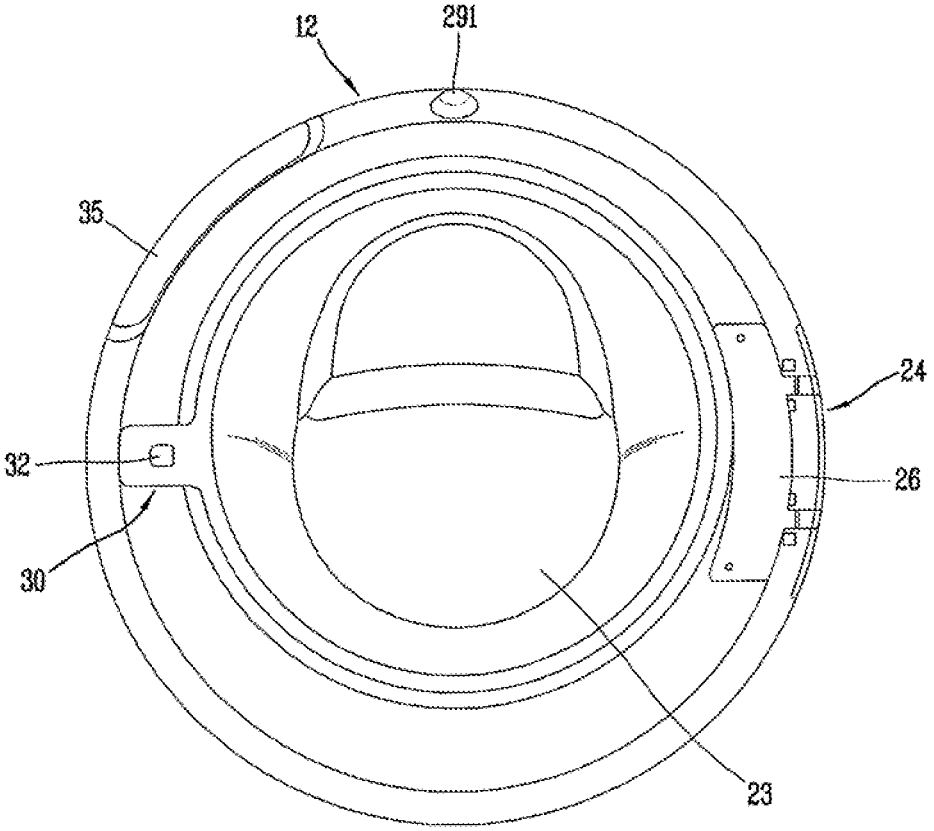
FIG. 10 is a schematic view illustrating a shape of the contact portion of FIG. 9, viewed from the rear of the door frame.

FIG. 9 is a schematic view illustrating a state in which a contact portion 291 protrudes from one side of the rear surface of the door frame 13 in accordance with another embodiment. FIG. 10 is a schematic view illustrating a shape of the contact portion 291 of FIG. 9, viewed from the rear of the door frame 13.

This embodiment is different from the previous embodiment of FIGS. 4 to 8 in that the contact portion 291 integrally protrudes from one side of the rear surface of the door frame 13. The contact portion 191 illustrated in FIGS. 4 to 8 protrudes in the curved shape from the upper portion (predetermined section) of the rear surface of the door frame 13 continuously along the circumferential direction so as to have the arcuate cross section (except for the handle), whereas the contact portion 291 according to this embodiment locally protrudes from the upper portion of the rear surface of the door frame 13.

In this embodiment, the contact portion 291 may protrude in various forms, such as an oval, circle, or rectangle, for example. In addition, a plurality of the contact portion 291 may be provided, and the plurality of contact portions 291 may be spaced apart from each other in the circumferential direction.

The other components are the same/like those of the previous embodiment. Thus, detailed description thereof has been omitted.

Embodiments disclosed herein solve problems of the related art. Embodiments disclosed herein provide a laundry treating apparatus capable of preventing periodic vibration and noise caused between a door and a main body due to collision between laundry, which spins together with a drum, and a door window, when the laundry is loaded in a large quantity inside of the drum. Embodiments disclosed herein provide a laundry treating apparatus having a door with a beautiful appearance, because there is no need to form a protruding structure on a rear surface of the door for mitigating an impact applied to the door.

Embodiments disclosed herein provide a laundry treating apparatus capable of alleviating an impact transferred to a main body from a door even without a separate buffer member, simplifying a structure, and reducing cost. Embodiments disclosed herein also provide a laundry treating apparatus capable of minimizing wear caused due to friction between a door and a main body. Embodiments disclosed herein provide a laundry treating apparatus capable of alleviating an impact applied to a main body due to contact between a door and the main body even in a closed state of the door.

According to embodiments disclosed herein, a contact portion which comes in contact with a main body may be provided at an upper portion on a rear surface of a door frame. Even though an impact is transferred to a lower side of a door through a door window, an upper side of the door may be maintained in a contact state with the main body by virtue of the contact portion when the door is closed, which may result in preventing vibration and noise caused between the door and the main body.

According to embodiments disclosed herein, the contact portion may be formed in a curved shape with a preset or predetermined curvature at the upper portion on the rear surface of the door frame along a circumferential direction so as to come in contact with the main body. When viewed with the naked eye, the door frame does not have a structure in which one side portion protrudes compared to another side portion, thereby realizing a door with a beautiful appearance.

According to embodiments disclosed herein, the contact portion may be formed integrally at the upper portion on the rear surface of the door frame so as to come in contact with the upper portion of the main body, thereby alleviating an impact by the contact portion even without a separate buffer member, simplifying a structure, and reducing material cost. The contact portion may be formed in a shape curved with a preset or predetermined curvature, and a recessed portion where a recess part or recess in contact with the contact portion starts to be recessed may be formed in a shape curved in an opposite direction to the contact portion. Accordingly, the contact portion may be externally brought into point contact or line contact with the recess part of the main body, so as to minimize a contact area between the door and the main body, thereby minimizing an occurrence of wear due to friction between the door and the main body.

The contact portion may have a cross section in an arcuate shape, and a recessed portion where a recess part accommodating part of the door starts to be recessed may be formed in a rounded shape, which may result in mitigating an impact transferred to the door upon the contact between the contact portion and the recess part even while the door is closed.

Embodiments disclosed herein provide a laundry treating apparatus that may include a main body and a door. A front panel of the main body may define a front surface of the main body. The front panel may be provided with a laundry inlet port. The front panel may be provided with a recess part or recess recessed therein. The recess part may surround the laundry inlet port.

The door may be rotatably mounted to the front panel to open and close the laundry inlet port. The door may include an outer frame, a door window, an inner frame, and a contact portion.

The outer frame may be provided with a front glass on a front surface thereof. An outer circumferential portion of the outer frame may protrude to outside of the recess part to surround an outer surface of the front glass. The door window may be disposed to correspond to the laundry inlet port, and an outer edge portion or edge of the door window may be accommodated inside of the recess part.

The inner frame may be disposed toward the recess part. An outer side of the inner frame may be connected to the outer circumferential portion of the outer frame. An inner side of the inner frame may be connected to the outer edge portion of the door window.

The contact portion may be provided between the outer side and the inner side of the inner frame. The contact portion may come in contact with the recessed portion of the recess part, when the door is closed.

The contact portion may absorb an impact transferred from a large quantity of laundry to the door when the large quantity of laundry is loaded, as an upper side of the door with respect to a horizontal center line horizontally passing through a center of the door in a radial direction may be in contact with the main body so as to be supported by the main body, and a lower side of the door may absorb the impact by being pushed forward by the impact transferred from the laundry. If the contact portion is spaced apart from the main body without contacting it, the same problems as in the related art may occur.

The inner frame may be formed in a ring shape and the contact portion may be located at an upper portion of the inner frame based on a horizontal center line horizontally passing through a center of the inner frame in a radial direction. Because a protruding portion is formed at a lower portion of the door window with respect to the horizontal center line, the contact portion may be located at the upper portion of the inner frame, in view of structural characteristics of the door window.

The contact portion may be formed in a shape curved from the outer side of the inner frame to the inner side of the inner frame in a direction toward the recess part. The contact portion may have a cross section in an arcuate shape. The contact portion may extend in a circumferential direction. The contact portion may extend along the circumferential direction, without protruding from the rear surface of the inner frame when a user views the rear surface of the inner frame, thereby obtaining a better appearance.

The contact portion may have a greater curvature than a lower portion of the inner frame. Accordingly, the contact portion may come in contact with a recessed portion where the recess part starts to be recessed, and the lower portion of the inner frame cannot come in contact with the recess part.

A top end of the outer side of the inner frame may be located higher than a contact point of the contact portion. The outer side of the inner frame may have a diameter greater than that of the recess part, and the inner side of the inner frame may have a diameter smaller than that of the recess part. The outer side of the inner frame may be spaced forward apart from a contact point of the contact portion. Thus, the door may be larger than the recess part in size.

A handle may be provided on an upper portion of the outer side of the inner frame. The handle may be recessed into the inner frame toward the front glass. The handle may be spaced apart from a top end of the contact portion in a circumferential direction of the inner frame.

The front glass may have front and rear surfaces in a shape of a circular plate. The outer frame may include a mounting guide that protrudes from the outer circumferential portion to surround an outer surface of the front glass.

The outer frame may include an adhesive groove and a flat portion. The adhesive groove may be formed in the flat portion for receiving an adhesive for adhering the front glass to the outer frame. The flat portion may be formed inside of the mounting guide. The outer frame may further include a curved portion. The curved portion may extend with a preset or predetermined curvature from inside of the flat portion toward the outer edge portion of the door window. An opening may be formed inside of the curved portion.

The outer frame may have a ring shape. The outer circumferential portion of the outer frame may have a diameter larger than that of the recess part.

A portion where the recessed portion starts to be recessed may be curved to be externally brought into contact with the contact portion. The contact portion may come in point contact or line contact with the recess part.

Embodiments disclosed herein provide a laundry treating apparatus that may include a main body provided with a front panel having a laundry inlet port, and a recess part or recess recessed into the front panel to surround the laundry inlet port, and a door rotatably mounted to the front panel to open and close the laundry inlet port. The door may include an outer frame that protrudes outward from the recess part and having an outer circumferential portion with a larger diameter than the recess part, and an inner frame provided with a contact portion in contact with a recessed portion of the recess part, and having an outer side protruding to outside of the recess part to be coupled to the outer circumferential portion of the outer frame, and an inner side accommodated inside of the recess part.

The contact portion may extend in a curved shape from the outer side to the inner side of the inner frame, so as to come in contact with a portion where the recess part starts to be recessed, when the door is closed. The outer frame and the inner frame may be disposed to cover the recess part.

With embodiments disclosed herein, a contact portion may be provided at an upper portion on a rear surface of a door frame, to come in contact with one side of an upper portion of a front panel provided on a main body when a door is closed, thereby preventing lifting of the door even if a door window collides with laundry, which rotates along an inner circumferential surface of a drum, when the laundry is loaded in a large amount. Left and right or lateral sides of the door frame may be fixed to a flat portion by a hinge unit and a locking unit. The contact portion provided on the upper portion of the rear surface of the door frame may come in contact with a recessed portion where a recess part or recess formed in a front panel starts to be recessed, so as to resist lifting of the door. Even if an impact is repeatedly applied from the rotating laundry to a lower portion of the door frame through the door window, the contact portion may be kept in contact with the main body, thereby remarkably reducing vibration and noise between the door and the main body.

The contact portion may extend to be curved in an arcuate shape along a circumferential direction of the door frame. Thus, the contact portion does not protrude from one side of the rear surface of the door frame but forms a curved surface smoothly connected to its adjacent portions without a bent portion, thereby allowing the door to have a beautiful appearance.

In particular, a rear surface of the door is brought into contact with the portion where the recess part starts to be recessed, by virtue of the contact portion. Accordingly, the contact portion covers an inside of the recess part. Therefore, the door window protruding from the rear surface of the door to the inner space of the main body may be covered, thereby improving an appearance of the door. In addition, the contact portion of the door comes in contact with the recessed portion where the recess part starts to be recessed without protruding from the rear surface of the door and also contacting a flat surface of the recess part, thereby preventing an increase in unnecessary material cost due to an increase in size of the contact portion.

The contact portion has a cross section in an arcuate shape and is curved toward the front panel or recess part, so as to come in point contact or line contact with an outer circumference of the recess part. Accordingly, a contact area of the contact portion may be minimized when the door is closed, thereby distributing an impact, which is applied to the main body when the contact portion of the door comes in contact with the recess part of the main body, along the circumferential direction of the recess part, which may result in minimizing an impact applied to the main body.

Even if the lower portion of the door frame is lifted inside of the drum due to an impact applied to the door window, the hinge unit and the locking unit coupled to the main body and the contact portion comes in contact with an upper end of the recess part when the door is closed. Accordingly, at least three support points, like an equilateral triangle, a rectangle, and a polygon, may be formed by the contact between the door and the main body, thereby reducing vibration or shaking of the door and absorbing an impact applied to the door.

An arcuate curved surface of the contact portion and an arcuate curved surface of an outer circumference of the recess portion may come in point contact or line contact with each other between the door and the main body, thereby minimizing friction between the door and the main body. Even if the door is lifted due to an impact transferred from laundry, the contact portion and the recess part are externally brought into contact with each other. Accordingly, a contact point between the contact portion and the recess part may move on the arcuate curved surface of the contact portion, thereby preventing separation between the contact portion of the door frame and the recess part of the main body so as to realize stable contact between them.

By stable contact between the contact portion of the door frame and the recess part of the main body, an impact transferred from inside of the drum through the door window may be mitigated. In addition, a separate buffer member between the door and the main body and an installation space of the buffer member may not be needed. Accordingly, the door may be more accommodated in the recess, thereby implementing a compact arrangement of the door.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a main body having a front panel with a laundry inlet port, and a recess recessed into the front panel to surround the laundry inlet port; and a door rotatably coupled to the front panel to open and close the laundry inlet port, wherein the door comprises:

an outer frame provided with a front glass on a front surface thereof, and having an outer circumferential portion that surrounds an outer surface of the front glass, the outer frame protruding outward from the recess;

a door window corresponding to the laundry inlet port and having an outer edge portion accommodated inside of the recess;

an inner frame that faces the recess, the inner frame having an outer side connected to the outer circumferential portion of the outer frame and an inner side connected to the outer edge portion of the door window; and a contact portion provided between the outer side and the inner side of the inner frame and formed in a shape curved from the outer side of the inner frame to the inner side of the inner frame in a direction toward the recess to contact a recessed portion of the recess when the door is closed, wherein the inner frame comprises a non-contact portion between the outer side and the inner side of the inner frame, wherein the non-contact portion is circumferentially spaced apart from the contact portion, and wherein the contact portion has a greater curvature than the non-contact portion of the inner frame such that the non-contact portion is configured to be spaced apart from the recess when the door is closed and while the contact portion is in contact with the recessed portion of the recess.

2. The apparatus of claim 1, wherein the inner frame has a ring shape, and wherein the contact portion is located at an upper portion of the inner frame based on a horizontal center line horizontally passing through a center of the inner frame in a radial direction.

3. The apparatus of claim 1, wherein a cross section of the contact portion has an arcuate shape.

4. The apparatus of claim 1, wherein the contact portion extends in a circumferential direction.

5. The apparatus of claim 2, wherein the contact portion has a greater curvature than a lower portion of the inner frame.

6. The apparatus of claim 1, wherein a top end of the outer side of the inner frame is located higher than a contact point of the contact portion with the recessed portion of the recess when the door is closed.

7. The apparatus of claim 1, wherein the outer side of the inner frame has a diameter greater than a diameter of the recess, and wherein the inner side of the inner frame has a diameter smaller than the diameter of the recess.

8. The apparatus of claim 1, wherein the outer side of the inner frame is spaced forward apart from a contact point of the contact portion with the recessed portion of the recess when the door is closed.

9. The apparatus of claim 8, wherein a handle is provided at an upper portion of the outer side of the inner frame.

10. The apparatus of claim 9, wherein the handle is recessed into the inner frame toward the front glass.

11. The apparatus of claim 9, wherein the handle is spaced apart from a top end of the contact portion in a circumferential direction of the inner frame.

12. The apparatus of claim 1, wherein front and rear surfaces of the front glass have a shape of a circular plate.

13. The apparatus of claim 12, wherein the outer frame comprises:

a mounting guide that protrudes from the outer circumferential portion to surround the outer surface of the front glass.

14. The apparatus of claim 13, wherein the outer frame comprises:

a flat portion having an adhesive groove configured to receive an adhesive to adhere the front glass to the outer frame and formed at an inner side of the mounting guide; and a curved portion that extends at a predetermined curvature from an inside of the flat portion toward the outer edge portion of the door window, and having an opening therein.

15. The apparatus of claim 1, wherein the outer frame has a ring shape, and wherein the outer circumferential portion of the outer frame has a diameter larger than a diameter of the recess.

16. The apparatus of claim 1, wherein a portion at which a recessed portion of the recess starts to be recessed is curved to be externally brought into contact with the contact portion, and wherein the contact portion is in point contact or line contact with the recess.

17. A laundry treating apparatus, comprising:

a main body having a front panel with a laundry inlet port, and a recess recessed into the front panel to surround the laundry inlet port; and a door rotatably coupled to the front panel to open and close the laundry inlet port, wherein the door comprises:

an outer frame that protrudes outward from the recess and having an outer circumferential portion with a larger diameter than a diameter of the recess; and an inner frame provided with a contact portion in contact with a recessed portion of the recess, and having an outer side that protrudes outside of the recess to be coupled to the outer circumferential portion of the outer frame, and an inner side accommodated inside of the recess, wherein the contact portion is formed in a shape curved from the outer side of the inner frame to the inner side of the inner frame in a direction toward the recess, wherein the inner frame comprises a non-contact portion between the outer side and the inner side of the inner frame, wherein the non-contact portion is circumferentially spaced apart from the contact portion, and wherein the contact portion has a greater curvature than the non-contact portion of the inner frame such that the non-contact portion is configured to be spaced apart from the recess when the door is closed and while the contact portion is in contact with the recessed portion of the recess.

18. The apparatus of claim 17, wherein the contact portion extends in the curved shape from the outer side to the inner side of the inner frame, so as to come in contact with a portion at which the recess starts to be recessed, when the door is closed.

19. The apparatus of claim 17, wherein the outer frame and the inner frame are disposed to cover the recess.

20. A laundry treating apparatus, comprising:

a main body having a front panel with a laundry inlet port, and a recess recessed into the front panel to surround the laundry inlet port; and a door rotatably coupled to the front panel to open and close the laundry inlet port, wherein the door comprises:

an outer frame that protrudes outward from the recess and having an outer circumferential portion with a larger diameter than a diameter of the recess; and an inner frame provided with a pivot portion in point or line contact with a portion of the recess about which the door pivots upon application of an internal force to the door, wherein the pivot portion is formed in a shape curved from an outer side of the inner frame to an inner side of the inner frame in a direction toward the recess, wherein the inner frame comprises a non-contact portion between the outer side and the inner side of the inner frame, wherein the non-contact portion is circumferentially spaced apart from the pivot portion, and wherein the pivot portion has a greater curvature than the non-contact portion of the inner frame such that the non-contact portion is configured to be spaced apart from the recess when the door is closed and while the pivot portion is in contact with the recessed portion of the recess.

21. The apparatus of claim 20, wherein the pivot portion is disposed at an upper portion of the inner frame.

22. A laundry treating apparatus, comprising:

a main body having a front panel with a laundry inlet port, and a recess recessed into the front panel to surround the laundry inlet port; and a door rotatably coupled to the front panel to open and close the laundry inlet port, wherein the door comprises:

an outer frame that protrudes outward from the recess and having an outer circumferential portion with a larger diameter than a diameter of the recess; and an inner frame provided with a contact portion in contact with a portion of the recess at an upper portion of the inner frame, wherein a gap is provided between the inner frame and the recess at a lower portion of the inner frame, wherein the contact portion is formed in a shape curved from an outer side of the inner frame to an inner side of the inner frame in a direction toward the recess, wherein the inner frame comprises a non-contact portion between the outer side and the inner side of the inner frame, wherein the non-contact portion is circumferentially spaced apart from the contact portion, and wherein the contact portion has a greater curvature than the non-contact portion of the inner frame such that the non-contact portion is configured to be spaced apart from the recess when the door is closed and while the contact portion is in contact with the recessed portion of the recess.

23. The apparatus of claim 22, wherein the contact portion along with a hinge unit and a locking unit provide a three point support for the door with respect to the recess.

* * * * *